United States Patent [19]

Ham

[11] 4,313,606

[45] Feb. 2, 1982

[54] BASEBALL GAME APPARATUS

[76] Inventor: Young S. Ham, 333-80, Songsu 2-Ka 1-dong, Songdong-Ku, Seoul, Rep. of Korea

[21] Appl. No.: 183,008

[22] Filed: Sep. 2, 1980

[51] Int. Cl.[3] ..... A63F 7/06; A63F 7/10

[52] U.S. Cl. ..... 273/89; 273/405; 273/DIG. 26; 124/16

[58] Field of Search ..... 273/89, 90, 357, 85 C, 273/85 D, 85 E, 382, 405; 124/16

[56] References Cited

U.S. PATENT DOCUMENTS

| | | | |
|---|---|---|---|
| 487,825 | 12/1892 | Curtis et al. | 273/89 |
| 637,549 | 11/1899 | Engel et al. | 273/89 |
| 1,094,559 | 4/1914 | Harrison | 273/89 |
| 2,294,035 | 8/1942 | Kellermann et al. | 273/89 X |
| 2,362,188 | 11/1944 | Clark | 273/89 |
| 4,116,442 | 9/1978 | Dickey | 273/89 |

*Primary Examiner*—George J. Marlo
*Attorney, Agent, or Firm*—Fleit & Jacobson

[57] ABSTRACT

A baseball game apparatus having a body with a top surface and a bottom surface, interconnected by first and second side surfaces. A plurality of vertically stacked plates defining stage fields are positioned at one end of the body. Side portions of the top surface are spaced from the side surfaces to define foul ball openings so that balls can fall from the top surface to the bottom surface. A portion of the bottom surface forms a ball collecting portion and the bottom surface is shaped or sloped to direct balls to the ball collecting portion. An opening is formed in a central portion of the top surface at a position spaced from the stage fields, the opening having a first portion for the passage of a bat and a second portion for the passage of the bat and a ball, which ball strikes a sounder on the bottom surface. A horizontally-extending bat supporting bar is positioned below the top surface with one end portion rotatably supported by one of the side surfaces of the body and another end portion supported by and extending through the other side surface to a handle. A bat has a first portion connected to the bar, a second portion forming a hitting portion, and a spring interconnecting the first and second portions. A ball guide rail extends downwardly from a pitching opening formed in one of the stage fields to the opening in the top surface for guiding a ball past the bat.

7 Claims, 3 Drawing Figures

BASEBALL GAME APPARATUS

BACKGROUND OF THE INVENTION

1. Field of the Invention

The present invention relates to game devices, apparatus, and instruments. More particularly, the invention relates to a baseball game device.

2. Description of the Prior Art

There are several different types of previously known baseball game instruments and apparatus. In one such type, a ball is guided along a surface of a base board, with a player hitting the ball with a bat moving horizontally. There is no exquisiteness to hit the ball in the air. The player should hit the ball to a designated hole representing bases so that the significance of the prior instruments is to simply select a direction of the hit ball.

BRIEF SUMMARY OF THE INVENTION

The present invention provides a baseball game apparatus for use in a limited space that simulates the real game of baseball. With the apparatus, a player is able to hit the ball in the air so that both base hits and home runs are possible.

The present invention relates to a baseball game instrument. According to the present invention, a ball guide rail is provided for a ball so that the ball is rolled in a strike course to a bat. The bat is rotatable about a horizontal axis to hit the ball when the ball arrives at a suitable place. An outfield formed as vertically arranged divided stages is positioned to receive a hit ball. If the hit ball enters into one of the divided stages in the outfield, a marker representing a runner is positioned on a game board in an opening corresponding to the base. Individual bases are designated by each of the stages in the outfield.

An aim of the present invention is to provide amusement of baseball in a limited small space in a room so that a player can feel and enjoy the game, as if the game were played outdoors on a conventional field.

According to the present invention, a marker representing a runner is moved to a base in accordance with the grade or base designated by each of the stages into which a hit ball enters. Namely, the field is divided into a plurality of preferably vertical stages, for instance three stages. When the ball enters into the lowest stage, the runner is moved one base only. When the ball enters into the middle stage, the runner is moved two bases. When the ball enters into the upper stage, the runner is moved three bases. However, when the ball flies over the upper stage, it is a home-run.

The invention, and its objects and advantages, will become more apparent in the detailed description of the preferred embodiment hereinafter presented.

BRIEF DESCRIPTION OF THE DRAWINGS

In the detailed description of a preferred embodiment of the invention hereinafter presented, reference is made to the accompanying drawings, in which.

DESCRIPTION OF THE PREFERRED EMBODIMENT

Figure 3:
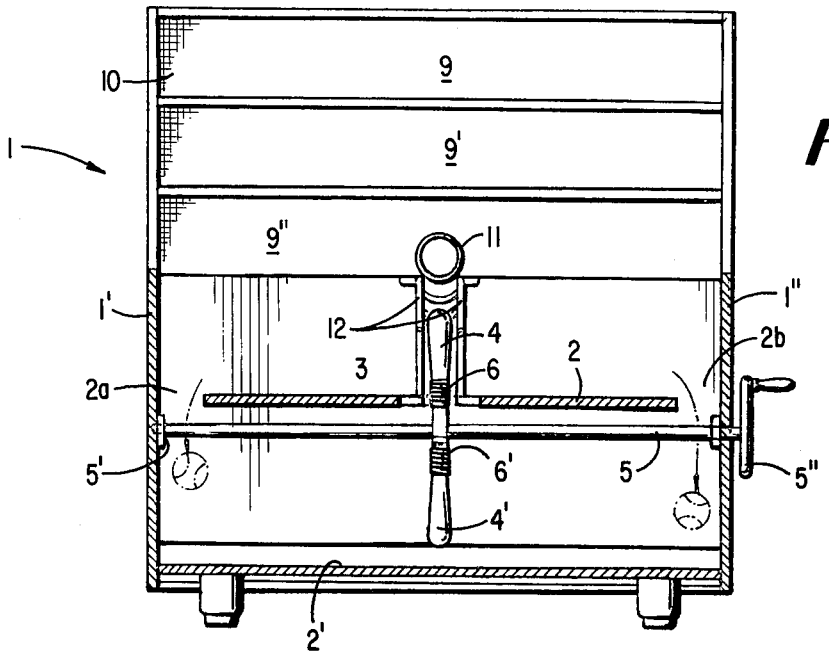
FIG. 3 is a view along line A—A in FIG. 2.
Figure 1:
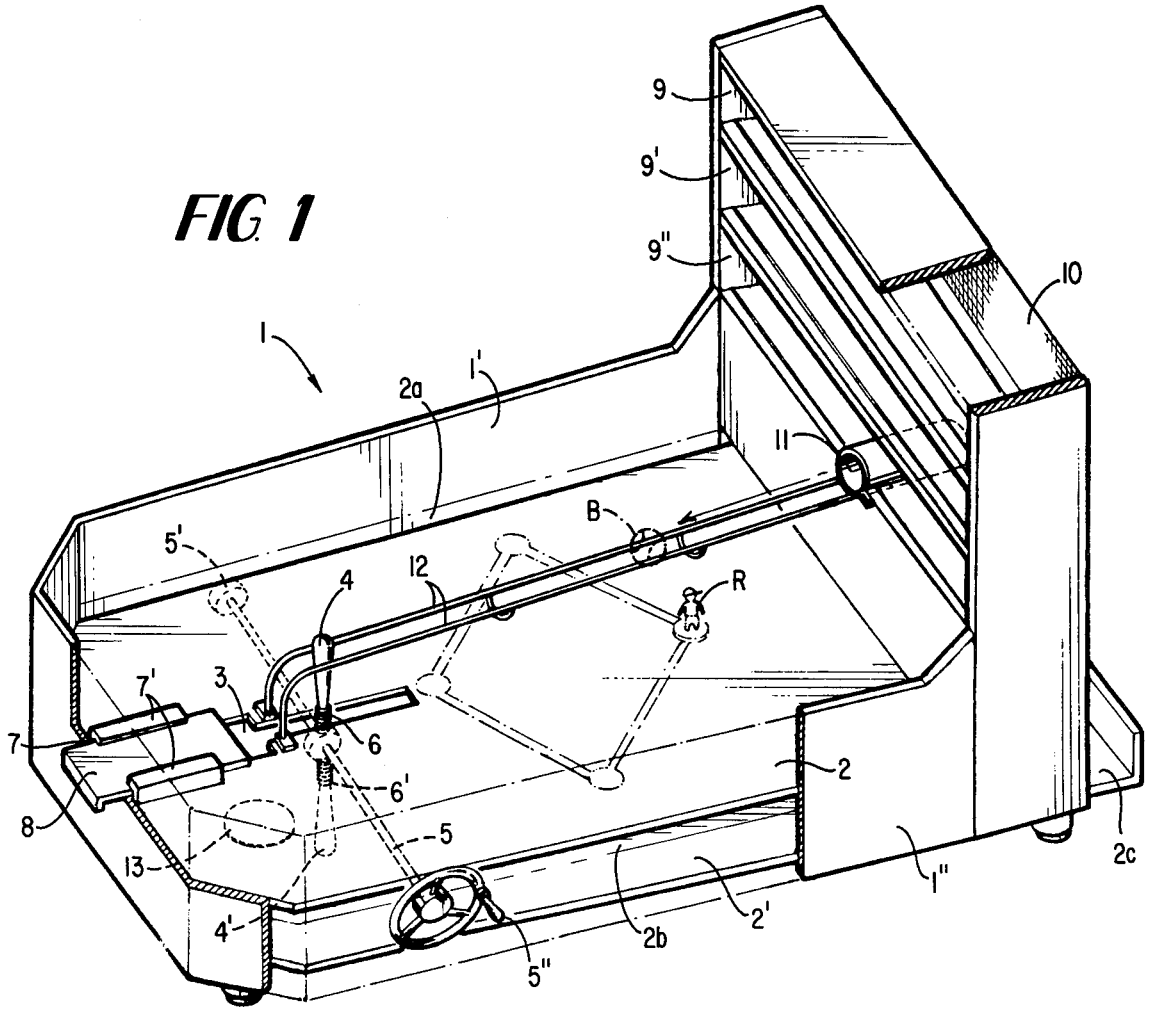
FIG. 1 is a perspective view of one embodiment of a baseball game apparatus according to the present invention, partially cut away to show internal construction of the apparatus.
Figure 2:
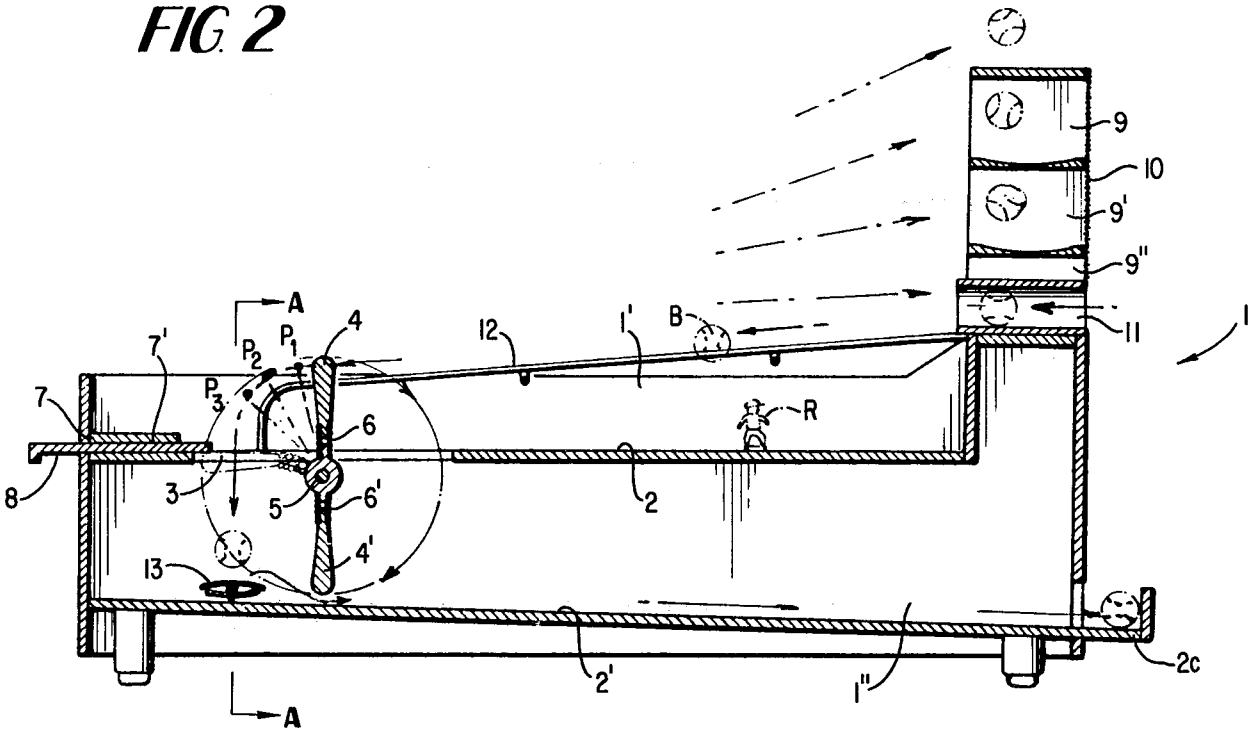
FIG. 2 is a vertical cross-sectional view of the baseball game apparatus of FIG. 1.

Because game apparatus are well-known, the present description will be directed, in particular, to elements forming part of, or cooperating more directly with, the present invention. Elements not specifically shown or described herein are understood to be selectable from those known in the art.

Referring now to the drawings, an embodiment of the baseball game apparatus, generally designated 1, of the present invention is illustrated. The apparatus 1 includes an upper board 2 and a bottom board 2'. The lower board 2' collects foul balls and strikes. The upper board 2 has foul ball collecting side holes **2*a* and 2*b* along both sides so that a foul ball can fall through onto the bottom board 2'. The bottom board 2' has a slope so that collected foul balls roll toward a ball collecting portion 2*c***.

On a central part of the upper board 2, a slot 3 is provided through which a bat is projected. The bat has two hitting portions (4 and 4') and a central portion supported for rotational movement about a bat supporting bar 5. Coil springs (6 and 6') interconnect the central portion with the hitting portions (4 and 4'). One end of the bar 5 is rotatably connected to a hinge or bearing 5' fixed on a side fence 1', and the other end extends through the side fence 1'' and is connected to a handle 5''. When the handle 5'' is rotated, the bat (4 and 4') is rotated by the rotation of the bat supporting bar 5.

Preferably, a control board or slider 8 is positioned on one end of the slot 3. The lateral position of the control board 8 is fixed by parallel supporting members 7'. The control board 8 is movable into a blocking position such that, when the handle 5'' is rotated, one of the hitting portions (4, 4') contacts the control board 8 and has further movement blocked by the control board. When movement of the bat hitting portion (4, 4') is blocked by the control board 8, one of the coil springs (6, 6') connected to the blocked bat hitting portion (4 or 4') is stressed so that the blocked bat hitting portion has a stored elastic force. Movement of the control board into an unblocking position allows rotation of the bat hitting portion so that a ball can be hit. When the bat hitting portion strikes or hits a ball (B) guided by a guide rail 12, the ball flies towards a vertically staged outfield connected to an end of the upper board (2). It is possible to hit the ball (B) to fly or go forwardly by an elastic or striking force of one of the bat hitting portions (4 or 4'), caused by an associated one of the coil springs (6 or 6'), when the control board is moved to an unblocking position to thereby release a bat hitting portion blocked by the bottom of control board 8. Alternatively, an appropriate one of the bat hitting portions can be rotated into contact with an upper surface of the control board. Release of handle 5'' would then allow rotation of the bat hitting portion by the stored spring force. It is also possible to eliminate the control board 8 so that movement of the bat hitting portions is controlled solely by rotation of handle 5''.

There are a plurality of vertically stacked plates defining three open stages (9, 9' and 9'') at the end of an outfield portion of the upper board 2. The rear side of the stages is covered with a net 10 so that, when the ball enters into and passes through one of the stages, the ball is caught in the net and directed to the ball collecting portion **2*c***.

A ball pitching hole 11 is formed in the back of, and extends through, the outfield. When the ball (B) is put into the ball pitching hole 11, the ball (B) rolls forwardly along the sloped guide rail 12 towards the bat. A player attempts to hit the rolling ball (B) by rotating the handle 5'', by moving the slider 8, or by rotating the handle and moving the slider. If the player fails to hit the ball (B), the ball falls downwardly through the slot 3. A sounder 13 is placed on the bottom board 2' in a position to be struck by a ball falling through the hole 3. After striking the sounder 13, the ball (B) is rolled to the ball collecting portion 2c. When the ball falls on the sounder 13, there is a sound which means a strike.

According to the present invention, the baseball game is played by two teams, as with an actual baseball game. A defensive player puts a ball into the sloped ball pitching hole 11 and an offensive player attempts to hit the ball (B) by rotating the handle 5''. When the defensive player puts the ball into the ball pitching hole 11, it is possible that the defensive player can optionally control the speed and strength of the ball (B) in order to cause strikes. As previously discussed, when the offensive player fails to hit the ball, the ball falls downwardly through the opening 3 and strikes the sounder 13 on the bottom board 2'. Hitting the sounder increases the strike count. However, on the other hand, by controlling the elastic as well as strength of the bat (4, 4') during its contact with the control board 8, because the bat hitting portions (4, 4') are connected to the bat supporting bar 5 by the coil springs (6, 6'), the offensive player can hit the ball in a high and long distance by controlling the rotation of the handle 5''.

According to the baseball game apparatus of the present invention, it is observed that, as illustrated in the accompanying drawing, when the ball (B) is hit at the point P3, the ball flies at the greatest height; when hit at the point P2, the ball flies at a medium height; and, when hit at the point P1, the ball travels horizontally. When the ball (B) flies forwardly over the upper stage, it is a home run. When the ball (B) enters into the upper stage 9, a doll (R) representing a base runner is moved three bases to represent a three base hit. When the ball (B) enters into the middle stage 9', the doll (R) is moved two bases to represent a two base hit. But, when the ball (B) enters into the lowest stage 9'', the doll (R) is moved only one base because it is a one base hit. If the offensive player fails to hit the ball three times, including foul balls which do not enter into the stages, it is a strike out, as with an actual baseball game.

According to the present invention, because the player hits the ball rolled along the guide rail which tracks a strike course, it is possible to enjoy exquisiteness, to induce selectively and to experience a variety of hittings at different positions. Because the baseball game apparatus of the present invention contains three stage fields, as well as a home run system, as determined by the distance that a ball flies, it is possible to feel the enjoyment of actual play and experience the interest of hitting the ball a high and long distance, in a small space.

Because the apparatus of the present invention has a simple construction, there is virtually nothing to cause mechanical trouble in the play, so that young children can play the game for a long time.

Previously, a specific embodiment of the present invention has been described. It should be appreciated, however, that this embodiment has been described for the purposes of illustration only, without any intention of limiting the scope of the present invention. Rather, it is the intention that the present invention be limited only by the appended claims.

What is claimed is:

1. Baseball game apparatus comprising:

a body having an upper board (2) and a bottom board (2'), the upper board (2) having foul ball collecting side openings (2a and 2b) extending along both sides, the bottom board (2') being sloped to direct balls falling on the bottom board through the foul ball collecting side openings to a ball collecting portion (2c) of the bottom board, the upper board (2) having a slot (3) positioned near one end thereof;

a bat supporting bar (5) rotatably supported by sides of the body;

a bat having hitting portions (4 and 4') supported by the bat supporting bar (5);

coil springs (6 and 6') for interconnecting the hitting portions and supporting bar;

a handle (5'') connected to the bat supporting bar (5) for rotating the bat;

three open stage fields (9, 9' and 9'') connected to an end portion of the body spaced furthest from said slot;

a net (10) for closing ends of the stage fields and for directing balls passing through the stage fields to the ball collecting portion;

a ball pitching hole (11) formed in, and extending through, one of the stage fields; and ball guide rail means (12) extending downwardly from the ball pitching hole (11) to the slot (3) for guiding a rolling ball (B) past a position in which the rolling ball is hittable by rotation of the bat.

2. A baseball game apparatus comprising:

a body having a top surface, a bottom surface, first and second side surfaces extending between sides of the top and bottom surfaces, and a plurality of vertically stacked plates defining stage fields positioned at one end of the top surface, side portions of the top surface being spaced from the side surfaces to define foul ball openings so that balls can fall from the top surface to the bottom surface, a portion of the bottom surface forming a ball collecting portion and the bottom surface being shaped to direct balls to the ball collecting portion, an opening being formed in a central portion of the top surface at a position spaced from the stage fields, the opening having a first portion for the passage of a bat and a second portion for the passage of the bat and a ball;

a horizontally-extending bat supporting bar positioned below the top surface and having one end portion rotatably supported by the first side surface of the body and another end portion supported by and extending through the second side surface;

a handle connected to a portion of the another end portion extending through the second side surface;

a bat having a first portion connected to the bar, a second portion forming a hitting portion, and a spring interconnecting the first and second portions, the hitting portion extending through the opening to a position above the top surface upon rotation of the handle; and ball guide rail means extending downwardly from a pitching opening formed in one of said stage fields to said opening in the top surface for guiding a ball past the bat, a guided ball being hittable into one of said stage fields by said bat upon rotation of said handle.

3. A baseball game apparatus according to claim 2, further comprising a net closing the rear of said stage fields for directing a ball passing through one of said stage fields to the ball collecting portion of the lower surface.

4. A baseball game apparatus according to claim 2, wherein said ball guide rail means comprises two spaced apart rails having upper ends connected to one of said plates defining stage fields and lower ends connected to portions of said top surface adjacent the central opening, the rails and bat supporting bar being positioned such that the hitting portion of the bat passes between and extends above portions of the rails upon rotation of the handle.

5. A baseball game apparatus according to claim 2, further comprising means positioned on the bottom surface beneath the opening in the top surface for making a sound when a ball passes through the opening.

6. A baseball game apparatus according to claim 2, further comprising a slider supported for sliding movement with respect to the top surface, the slider being movable between a blocking position partially blocking the second portion of the opening for blocking movement of a rotating bat and an unblocking position free from contact with a rotating bat.

7. A baseball game apparatus according to claim 2, wherein a playing surface having bases is defined on an upper portion of the top surface, and wherein the apparatus further comprises at least one player positionable on the playing surface on a desired base.

* * * * *